United States Patent [19]

Wright

[11] 4,372,483

[45] Feb. 8, 1983

[54] FLUID CONTAINMENT ANNULUS FOR FIXED ANGLE ROTORS

[75] Inventor: Herschel E. Wright, Santa Clara, Calif.

[73] Assignee: Beckman Instruments, Inc., Fullerton, Calif.

[21] Appl. No.: 268,540

[22] Filed: May 29, 1981

[51] Int. Cl.[3] ..... B04B 7/02; B04B 7/08

[52] U.S. Cl. ..... 494/16; 494/38

[58] Field of Search ..... 233/26, 1 A, 1 B, 1 R, 233/27, 28; 424/177, 72

[56] References Cited

U.S. PATENT DOCUMENTS

| | | | |
|---|---|---|---|
| 2,699,289 | 1/1955 | Allen et al. | 233/26 |
| 3,071,316 | 1/1963 | Piemonte et al. | 233/26 |
| 3,420,437 | 1/1969 | Blum | 233/26 |
| 3,819,111 | 6/1974 | Romanauskas et al. | 233/27 |
| 3,961,745 | 6/1976 | Wright | 233/26 |
| 4,202,487 | 5/1980 | Edwards | 233/1 A |

*Primary Examiner*—Robert W. Jenkins

*Attorney, Agent, or Firm*—R. J. Steinmeyer; F. L. Mehlhoff; William H. May

[57] ABSTRACT

A centrifuge rotor for carrying a plurality of centrifuge tubes at a fixed angle with respect to the spin axis of the rotor wherein the rotor has a containment annulus located above the tube cavities in the rotor for containment of any excess fluid from the centrifuge tubes during centrifugation. The containment annulus is designed in such a manner that it will receive all possible excess fluids from the centrifuge tubes during centrifugation and none of the excess fluid will contact or exert pressure on the rotor lid.

4 Claims, 5 Drawing Figures

FLUID CONTAINMENT ANNULUS FOR FIXED ANGLE ROTORS

BACKGROUND OF THE INVENTION

The present invention is directed to a fixed angle ultracentrifuge rotor and, more particularly, is directed to a fixed angle rotor having a fluid containment annulus formed in it to retain any spilled or excess fluid from the centrifuge tubes in the rotor.

In most presently used fixed angle rotors, a plurality of centrifuge tube cavities are formed in an annular arrangement about the center of the rotor. These cavities are oriented at some acute angle to the spin axis of the rotor and are designed to receive a plurality of sample carrying centrifuge tubes. The angled orientation of the tubes permits the density gradient bands to be relatively narrow while, at the same time, a tube cap on the tubes is generally not required if the proper amount of fluid has been placed in the tube. However, in some instances it may be desirable to put tube caps on the tubes to retain the fluid within the tubes in case too much fluid has been placed within the tubes.

As more research is conducted into the areas of pathogenic and radioactive substances, it is more and more important to maintain the cleanliness of the overall centrifuge, including the rotor chamber in the centrifuge. This is necessary in order to protect the users of the centrifuge who are running these critical experimental research investigations of various hazardous materials. Quite often in presently used fixed angle rotors the tube is placed within the rotor with a lid placed on the rotor covering the cavity areas of the rotor containing the tubes. Since the tubes are oriented at an acute angle with respect to the spin axis, the tubes should not be filled completely to their top edge with any fluid sample because, during centrifugation, the surface level of the fluid will reoirent and may be directed out of the tube if no cap is located on the tube or, if a tube cap is used, may force the cap to be separated from the tube during centrifugation. Although there are instructions that a tube should be filled only to a certain level, in practice the operators of the centrifuges have difficulty in placing the proper amount of fluid in the tube. Many times the tube is inadvertently filled to a slightly larger volume than it should for use in a particular fixed angle rotor.

As a result, fluid will escape from the uncapped centrifuge tubes and collect in the area of the rotor above the centrifuge tube cavities. As a result, during centrifugation, pressure will be exerted on the rotor lid by this fluid as a result of centrifugally induced forces, causing a potential leakage of the fluid into the rotor chamber. If the rotor contains a hazardous material, a problem can arise, since, once the centrifugation run is completed and the operator opens the centrifuge rotor chamber, he may be exposed to some possible hazardous material if it has escaped the rotor. Therefore, it is important to be able to contain any excess fluid which may escape from the tube or the tube cavity during centrifugation, within the rotor itself. Also, there is the concern with respect to aerosoling of various hazardous materials. For a more detailed description of the particular hazards of centrifugally induced aerosoling of a fluid sample, attention is directed to co-pending patent application Ser. No. 164,877, filed July 1, 1980 by Mark J. Cowell and Thomas D Sharples.

It is important that the excess fluid not exert a pressure on the rotor lid as a result of centrifugally induced forces on the rotor lid since the seal between the rotor lid and the rotor body will in some instances be incapable of maintaining its proper seal when operating at very high centrifuge speeds.

SUMMARY OF THE INVENTION

The present invention is directed to the incorporation of a fluid containment annulus in the upper portion of a fixed angle rotor, so that any excess fluid from the centrifuge tubes in the rotor is contained during centrifugation in this containment annulus. None of the excess fluid material will contact the rotor lid during centrifugation. Therefore, the integrity of the seal between the rotor lid and the rotor body is maintained.

The containment ring is formed by an inward projecting lip around the upper perimeter of the rotor body, so that an annular recess area is formed to create the annulus for containing the excess fluid. The size or volume of the containment annulus is designed to contain all of the excess fluid that would exist in the rotor if all of the tubes in the rotor were filled to their maximum excess.

DETAILED DESCRIPTION OF THE INVENTION

Figure 1:
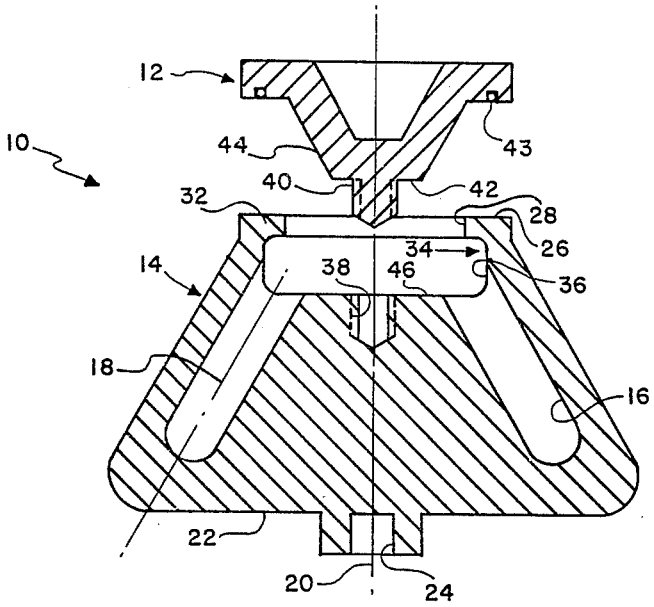
FIG. 1 is a sectional elevation view of the rotor body and lid separated from each other.

FIG. 1 shows a centrifuge rotor 10 having a lid 12 and a rotor body portion 14. Positioned in an annular arrangement around the rotor body portion 14 are a plurality of centrifuge tube cavities 16 which have their longitudinal center line 18 oriented at an acute angle with respect to the spin axis 20 of the rotor. Although only two tube cavities 16 are shown, it should be noted that several tube cavities 16 exist in a close annular arrangement around the periphery of the rotor 14 to form a uniform balanced array. The number of cavities 16 in the rotor will depend on the size of the rotor and the size of the tube cavities. Located on the bottom 22 of the rotor is a connection junction 24 designed to receive a drive spindle (not shown) for rotating the rotor at operational speeds.

Figure 2:
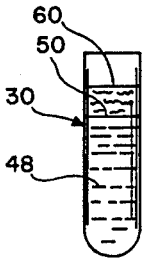
FIG. 2 is an elevation view of a sample containing centrifuge tube in its vertical orientation.
Figure 3:
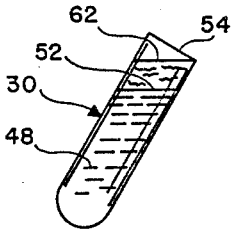
FIG. 3 is an elevation view of a sample containing centrifuge tube at an acute angle orientation.
Figure 4:
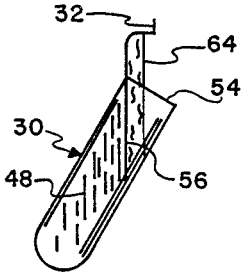
FIG. 4 is an elevation view of a sample containing tube at an acute angle orientation with a portion of the rotor containment annulus shown.

Located adjacent the top 26 of the rotor body 14 is an opening 28 for allowing access to the cavities 16 in the body portion 14 for placement and removal of centrifuge tubes 30 shown in FIGS. 2, 3 and 4. Also located adjacent the opening 28 is an inwardly projecting lip or flange 32 which forms with the interior wall 34 above the cavity 16 an enclosed area or annulus 36 which is designed to contain fluid as will be explained below.

A threaded connection aperture 38 is located in the top central portion of the rotor body 14 and is designed to receive the projecting threaded connection stud 40 on the lower surface 42 of the lid 12. The lid 12 has an O-ring seal 43 which, when in contact with the top 26 of the body portion 14, provides a seal between the lid and the body portion 14. The lid 12 has a depending frustoconical portion 44 which is designed to project into the opening 28 adjacent to the central top surface 46 of the body portion 14 and creates interior space 45 between the lid 12 and the body portion 14 above the tube cavity 16 as shown in FIG. 5.

Figure 5:
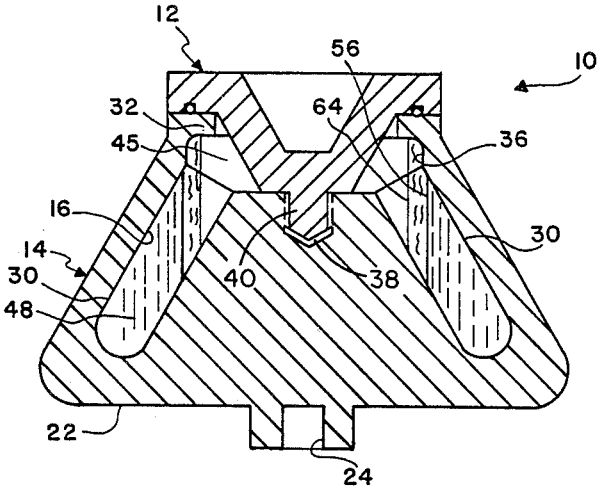
FIG. 5 is a sectional elevation view of the lid connected to the rotor and a plurality of centrifuge tubes placed in the tube cavities of the rotor.

The lid 12 in FIG. 5 is shown in sealing engagement with the lower body portion 14 of the rotor. Positioned within the tube cavities 16 are centrifuge tubes 30 containing a fluid sample 48. As shown more clearly in FIG. 2, when the centrifuge tube 30 is in a vertical or upright position, the fluid sample 48 is filled to a specified level 50 for placement in the angle tube rotor 10. Since the tube will assume an acute angle orientation with respect to the spin axis of the rotor, the fluid level will change to a position 52 as shown in FIG. 4 wherein the fluid level 52 will be closer to the top 54 of the tube 30 adjacent the centrifugal side of the tube. When the tube 30 has been placed with its fluid sample 48 having the fluid level at 50 in FIG. 2 into the rotor 10, the rotor can then be operated at operational speed. When the rotor is running at its operational speed, the fluid level will reorient to the surface 56 shown in FIG. 4 wherein the sample 48 is retained in the tube 30, but the surface 56 will be adjacent the top edge 54 adjacent the centripetal side of the tube.

However, in some instances, the amount of fluid sample placed within the centrifuge tube 30 in FIG. 2 results in the fluid level 60 being higher or greater than it should be, so that, when the tube is placed within the centrifuge rotor 10, the fluid level will assume the orientation of 62 in FIG. 3. During high speed centrifugation the centrifugally induced forces exerted on the fluid sample 48 will result in a reorientation of the surface 62 to a new surface 64 as shown in FIG. 4 and in FIG. 5. In this situation a portion of the fluid escapes from the centrifuge tube 30 and will enter into the area 36 above the tube cavity 16. In presently used centrifuge rotors, this excess fluid would result in a force being placed on the rotor lid, resulting in possible adverse effects on the sealed connection between the lid and the rotor body. However, as shown in FIG. 5, the excess fluid exhibited by the surface level 64 will be retained below the lip 32 within the containment annulus or recess 36, so that none of the fluid sample will exert a pressure or force on the lid 12.

If any operator inadvertently places too much fluid sample within the centrifuge tubes 30 that are placed within the rotor, the containment annulus 36 is designed to be large enough to contain the excess fluid from all tubes in the rotor during centrifugation. None of the excess fluid will contact the lower surface of the lid 12. Therefore, during ultracentrifugation with extreme high speeds of the centrifuge rotor, the centrifugally induced forces exerted by the excess fluid in the rotor will not produce any centrifugally induced forces on the lid, causing possible separation or leakage in the seal between the rotor lid and the rotor body.

Although a particular annulus has been shown and described in the present application, it is envisioned that other specific designs could be utilized without departing from the spirit and scope of the present invention directed to the formation of some type of containment annulus, cavity or clearance volume above the rotor tube cavities, so that all excess fluid within the rotor is captured within this area and none of it will exert a force on the rotor lid.

What is claimed is:

1. A centrifuge rotor comprising:

a lower rotor portion with an upper open end;

means within said lower rotor portion for receiving and supporting a plurality of centrifuge tubes at a fixed angle with respect to the spin axis of said rotor, said receiving and supporting means designed to contain a specified amount of a fluid sample in said each of said tubes;

means for forming an enclosed area around the perimeter of said open end of said lower rotor portion, said enclosed area forming means capturing any of said fluid sample from said tubes which is in excess of said specified amount during centrifugation; and a lid for covering said open end of said lower rotor portion, said enclosed area forming means being positioned adjacent said lid in such a manner that none of said fluid sample in excess of said specified amounts being retained in said area contacts said lid during centrifugation.

2. A centrifuge rotor comprising:

a rotor body having a plurality of cavities for the receipt of a plurality of centrifuge tubes and having an upper opening;

an annular inward projecting flange adjacent said opening forming an annular recess, said recess being above said cavities;

a lid; and means for attaching said lid to said rotor body, said recess having sufficient volume so that any excess fluid in said tubes will be captured in said recess and not contact said lid during centrifugation.

3. A centrifuge rotor comprising:

a lower rotor portion having a plurality of cavities for receipt of centrifuge tubes, said cavities being oriented at an angle to the spin axis of said rotor, said lower rotor portion having an opening for placement and removal of said tubes from said rotor;

an inward projecting lip around the perimeter of said opening projecting toward said spin axis to form an annulus above said cavities; and a lid for connection to said lower rotor portion to enclose said opening, said annulus capturing any of a fluid sample placed in said tubes which is spilled out of said tubes during centrifugation, none of said spilled fluid sample exerting direct pressure on said lid during centrifugation.

4. A centrifuge rotor comprising:

a lower portion having a plurality of cavities;

at least one centrifuge tube for placement in one of said cavities, said tube being oriented at an angle to the spin axis of said rotor and receiving a fluid sample for centrifugation, said angled orientation of said tube in said cavity limiting said fluid sample to a specified level in said tube;

a containment annulus around the perimeter of said lower portion above said cavities;

a lid; and means for connecting and sealing said lid to said lower rotor portion, said annulus containing any fluid that is placed in said tube above said specified level and preventing direct contact of said any fluid with said sealed lid during centrifugation.

* * * * *